US005546706A

United States Patent [19]

Coupet

[11] Patent Number: 5,546,706

[45] Date of Patent: Aug. 20, 1996

[54] SLIDING DEVICE FOR A SLIDING PANEL

[76] Inventor: Jean-Marie Coupet, 16, rue du Quesne, 62840 Fleurbaix, France

[21] Appl. No.: 427,803

[22] Filed: Apr. 26, 1995

[30] Foreign Application Priority Data

Apr. 27, 1994 [FR] France ..... 94 05344

[51] Int. Cl.[6] ..... E05D 13/02

[52] U.S. Cl. ..... 49/420; 16/105; 49/404; 49/421; 49/425

[58] Field of Search ..... 49/420, 421, 425, 49/404, 417; 16/105, 99

[56] References Cited

U.S. PATENT DOCUMENTS

| | | | |
|---|---|---|---|
| 3,716,890 | 2/1973 | Benson | 16/105 X |
| 3,774,342 | 11/1973 | Thom | 49/420 |
| 4,189,870 | 2/1980 | Helmick | 49/420 |
| 4,208,755 | 6/1980 | Shepherd | 49/404 X |
| 4,674,232 | 6/1987 | Rosada . | |
| 5,161,330 | 11/1992 | Auriemma . | |

*Primary Examiner*—Philip C. Kannan
*Attorney, Agent, or Firm*—Ladas & Parry

[57] ABSTRACT

The sliding device for a sliding panel comprises:

a) a support which is shaped in or attached to the bottom portion of the panel, said support having a downwardly open upside-down U-shape;

b) an oscillating arm secured to the support about a pivot axis which is horizontal and which extends transversely relative to the U-shape;

c) sliding means fixed towards the free end of the oscillating arm;

d) a pivoting cam which is secured to the support by a first axis of rotation and bears against the oscillating arm; and e) an adjustment screw which is fixed relative to the support and whose displacement serves to adjust the angle of rotation of the cam by means of a linkage between the cam and the adjustment screw.

It may also include means for locking the oscillating arm in position relative to the support whenever the sliding means is in its high position within the support. The oscillating arm may include means for securing a cleaning pad suitable for bearing against the roller wheel and/or for extending in the form of a loop beneath the oscillating arm.

9 Claims, 2 Drawing Sheets

SLIDING DEVICE FOR A SLIDING PANEL

The present invention relates to a sliding device for fixing to or being formed at the bottom of a sliding panel, in particular for a door or a window. More particularly, the invention relates to a device in which the sliding means, e.g. a roller wheel or a sliding shoe, is adjustable in height by a set of means including an oscillating arm, a pivot cam, and an adjustment screw.

BACKGROUND OF THE INVENTION

A device of this type is known from document FR 2 263 362. Such a device includes a U-shaped support that is open downwardly, the web of the U-shape being directed towards the bottom of the panel or being constituted by the bottom portion of said panel. The oscillating arm is secured to the support by means of a pivot pin which is both horizontal and transverse relative to the U-shape. The roller wheel is secured near the free end of the oscillating arm. Rotation of the pivot cam serves to cause the oscillating arm to pivot about its axis. Displacement of the adjustment screw, by rotation of the screw, enables the angle of rotation of the cam to be adjusted.

In the above-specified prior document, the cam is mounted on the oscillating arm and consists in a T-shaped bearing element having one arm that bears against the web of the U-shape and whose other arm bears against the free end of the threaded shank constituting the adjustment screw, which screw is generally also mounted on the oscillating arm. Thus, to adjust the height of the roller wheel, the user rotates the adjustment screw, thereby displacing the threaded shank of said screw relative to the oscillating arm, with the free end of the screw bearing against the second arm of the cam. This causes the cam to rotate because the first arm is bearing against the web of the U-shape, thereby causing the oscillating arm to rotate since it is secured to the axis of rotation of said cam.

In the embodiment proposed in prior document FR 2 263 362, as explained above, the adjustment screw is secured to the oscillating arm such that said screw follows any motion imparted to said oscillating arm throughout adjustment. According to the Applicant, this constitutes a drawback insofar as it is not very convenient for a user to perform an adjustment operation and, above all, insofar as the screw rapidly becomes difficult to access when the oscillating arm is in a low position.

OBJECT AND SUMMARY OF THE INVENTION

The object of the present invention is to propose a sliding device for a sliding panel that mitigates the above-specified drawback in that the adjustment screw is fixed constantly relative to the support throughout adjustment and regardless of the position of the oscillating arm.

This object is achieved by the device of the invention which includes, as known from document FR 2 263 362:

a) a support which is shaped in or attached to the bottom portion of the panel, said support having a downwardly open upside-down U-shape;

b) an oscillating arm secured to the support about a pivot axis which is horizontal and which extends transversely relative to the U-shape;

c) sliding means fixed towards the free end of the oscillating arm;

d) a pivoting cam which, when rotated, is suitable for causing the oscillating arm to pivot; and e) an adjustment screw whose displacement serves to adjust the angle of rotation of the cam.

In characteristic manner, according to the invention, the cam is secured to the support via a first axis of rotation and bears against the oscillating arm.

Also, to control rotation of the cam under drive from the adjustment screw, the device includes a linkage between the cam and the adjustment screw, said screw being held stationary relative to the support.

Thus, to adjust the height of the sliding means, the user turns the adjustment screw, thereby causing corresponding displacement of the linkage and rotation of the cam about the first axis which is secured to the support. During such rotation, the cam bears against the oscillating arm and correspondingly drives vertical displacement thereof.

Preferably, the linkage comprises two links having respective first ends fixed on either side of the cam by means of a second axis of rotation secured thereto and disposed eccentrically relative to the first axis of rotation which is secured to the support, and having respective second ends secured on either side of a transverse plate which is provided with a tapped orifice, the threaded shank of the adjustment screw passing through said tapped orifice in such a manner that rotation of the screw causes the plate to move rectilinearly along the threaded shank of the screw. The displacement of the transverse plate along the threaded shank because of rotation of the screw acts via the two links to displace the cam angularly about the first axis of rotation mounted on the support, and to bear said cam against the oscillating arm.

Advantageously, the support includes a housing in which the head of the adjustment screw is positioned in fixed manner. Thus, during rotation of the screw, the head remains continuously in the housing.

In a preferred embodiment, the downwardly open U-shaped support further includes two flaps extending the two flanges of the U-shape and including two notches formed in the tops of the flaps to act as the housing for the head of the screw.

As will be understood on reading the description given below, this particular disposition is most advantageous when assembling the various component elements of the present device.

Preferably, the cam is substantially in the form of one-fourth of an ellipse, with the first axis of rotation being situated close to a central zone of the ellipse while the second axis of rotation is located towards its periphery, in the vicinity of the small axis of the ellipse. This shape comprising one-fourth of an ellipse enables the height of the oscillating arm to be adjusted smoothly, without jolting, and without generating friction forces that are excessive.

Another object of the invention is to provide a sliding device for a sliding panel that avoids the panel being derailed in the event of mis-operation, for whatever reason. When the sliding means is a roller wheel, such derailment can occur if the panel is raised so that the roller wheel is extracted from its rail.

According to the invention, given that the oscillating arm is held on the support solely by its pivot pin, if the panel is raised, then the arm will pivot about its axis of rotation under the effect of the weight of the sliding means mounted at the free end thereof. In this way, the invention avoids any risk of derailment.

However, this has the drawback that during installation or removal of the panel, the oscillating arm tends to move out from the support and hang beneath it under the effect of the weight of the sliding means.

The Applicant has remedied this drawback by proposing a device as defined above which further includes means for locking the oscillating arm in position relative to the support when the sliding means is in its high position in the support.

Thus, before performing disassembly, the user turns the adjustment screw so as to raise the sliding means into the support in such a manner as to enable the locking means to hold the pivot arm in such position.

In a particular embodiment of the locking means, the oscillating arm is provided with a peg and the support includes a notch in at least one of the flanges of its U-shape, the shape of the notch allowing the peg to pass therealong while the height of the sliding means is being adjusted, and also allowing the peg to be engaged in a snap-fastening manner when the sliding means reaches its high position.

Another object of the invention is to provide a sliding device for a sliding panel that includes a roller wheel and that performs continuous cleaning of the roller wheel and/or of the rail in which the said wheel bears, whenever the panel slides.

This object is achieved by the device of the invention in which the oscillating arm includes means for fixing a cleaning pad suitable for bearing against the roller wheel and/or suitable for extending beneath the oscillating arm.

The pad is constituted by a semi-rigid tape having one of its faces lined with bristles, the oscillating arm advantageously being constituted by a channel section bar whose transverse web is provided with slots through which said tape passes, thereby enabling the tape to be positioned in the form of a loop that extends between the flanges of the channel section beneath the pivoting arm and also bearing against the roller wheel.

BRIEF DESCRIPTION OF THE DRAWINGS

The present invention will be better understood on reading the following description of the roller device for a sliding panel having a fixed adjustment screw as illustrated in the accompanying drawings, in which.

MORE DETAILED DESCRIPTION

A sliding panel, e.g. of a door or a window, is displaced by applying a certain number of roller wheels in a sliding rail. The roller wheels are received in the bottom portion of the panel which is shaped to accommodate them, or else the roller wheels are housed in housings that are fixed within said bottom portion.

The present invention relates to a roller housing 1 that includes a roller wheel 2 together with a device for adjusting the height of said wheel 2 by means of an adjustment screw 3 which is disposed in the housing 2 in such a manner as firstly to be easily accessible by the user from the lateral upright of the panel, and secondly to remain fixed in position throughout vertical adjustment of the roller wheel.

Figure 1:
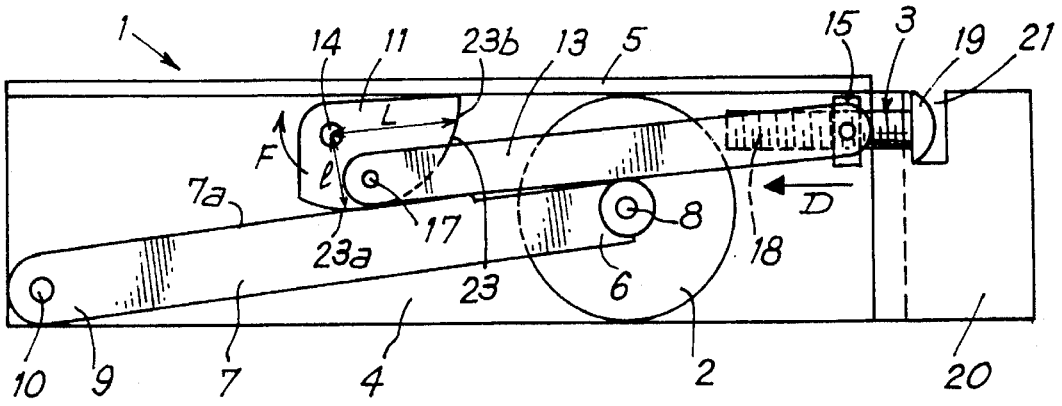
FIG. 1 is a diagrammatic longitudinal section through a roller housing adjusted to take up its position in which the roller wheel is retracted.
Figure 2:
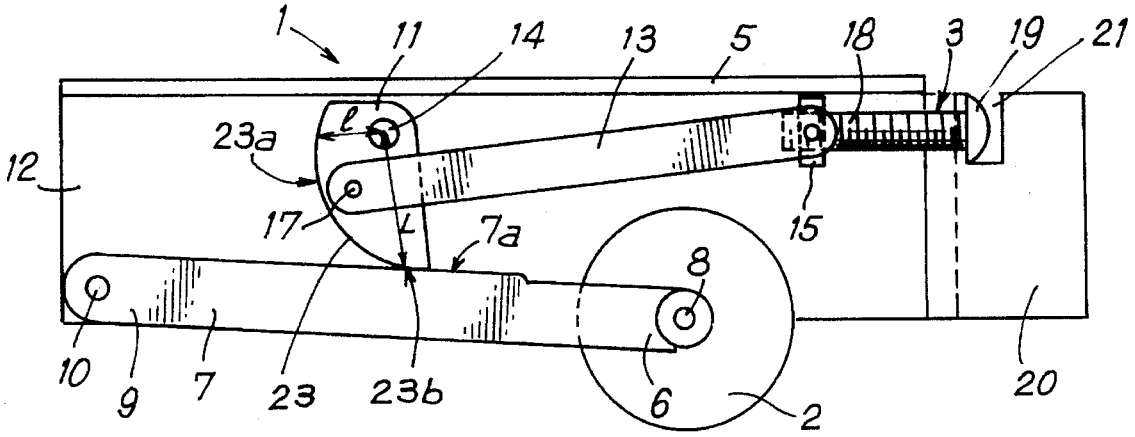
FIG. 2 is a diagrammatic section through the housing of FIG. 1 adjusted to a position in which the wheel is extended.
Figure 3:
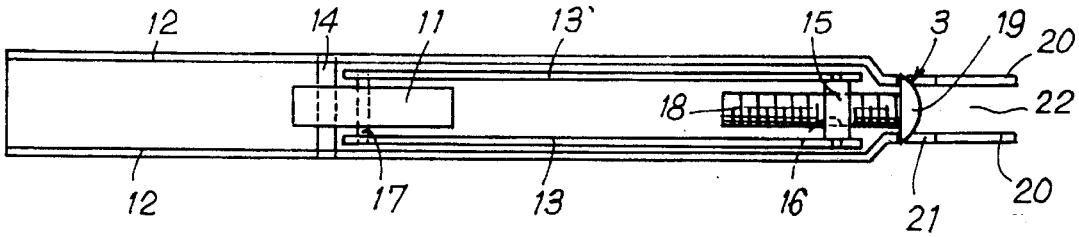
FIG. 3 is a view of the underside of the housing with its oscillating arm and its roller wheel omitted.

As can be seen clearly on examining FIGS. 1 and 2, the roller housing 1 of the invention comprises a channel section bar 4 which is downwardly open and whose transverse base or web 5 is suitable for fixing to the bottom portion of the panel (not shown).

The roller wheel 2 is rotatably mounted at one end 6 of an "oscillating" arm 7. More precisely, the axis of rotation 8 of the roller wheel 2 extends horizontally and transversely relative to the two lateral and vertical flanges 12 of the channel section bar 4.

The opposite end 9 of the oscillating arm 7 is fixed in the lower portion of the bar 4 to its vertical and lateral flanges 12 on a pivot pin 10 which is thus parallel to the axis of rotation 8 of the wheel 2.

The height of the roller wheel 2 is adjusted by the adjustment device which comprises a cam 11, a set of links 13 and 13', and the adjustment screw 3.

These three components are housed inside the bar 4 as follows. The cam 11 is mounted to rotate relative to the bar 4 about an axis 14. The two links 13 and 13' are fixed respectively to the cam 11 and also to a plate 15 which is provided with a tapped orifice 16. More precisely, the two links 13 and 13' are fixed on either side of the cam 11 at one end by means of a shank 17 that passes through the cam 11 and that is free to rotate relative thereto. The opposite ends of the two links 13 and 13' are fixed on either said of the transverse plate 15. The ends of the two links 13 and 13' are fixed to the plate 15 in such a manner as to allow said links 13 and 13' to move angularly a certain amount relative to the plate 15. This can be achieved, for example, by the ends of the links 13 and 13' having recesses that receive shoulders (not shown) projecting from the plate 15.

The threaded shank 18 of the adjustment screw 3 passes through the tapped orifice 16 of the transverse plate 15, with the tapping and the thread corresponding so that rotation of the threaded shank 18 gives rise to rectilinear displacement of the plate 15.

The head 19 of the adjustment screw 3 is secured in a fixed position relative to the bar 4. For this purpose, the vertical side flanges 12 of said bar 4 are extended by two parallel flaps 20 that are open on three sides. The top portions of the two flaps 20 include two facing notches 21 of a size suitable for receiving the head 19 of the adjustment screw 3 in either of the notches transversely relative to the two flaps 20. In this way, the head 19 of the adjustment screw 20 is accessible to the user via the open face 22 of the two flaps 20 where they extend the bar 4. Furthermore, it is held in position by its housing which is constituted by the two notches 21.

The active outside surface 23 of the cam 11 is substantially in the form of one-fourth part of an ellipse. It is this active surface 23 that bears against the oscillating arm 7 while the height of the roller wheel 2 is being adjusted.

This vertical adjustment is implemented in a manner that can be seen clearly on examining FIGS. 1 and 2.

FIG. 1 shows the relative disposition of the members of the roller housing 1 when the wheel 2 is in its retracted position inside the bar 4. Under such circumstances, the transverse plate 15 is in its closed position relative to the head 19 of the adjustment screw 3. The axis 17 at the ends of the links 13 and 13' is closer to the adjustment screw 3 than is the axis of rotation 14 of the cam 11. Under such conditions, the active surface 23 bears against the oscillating arm 7 in a zone 23*a* that is close to the axis 17, whereas the zone 23*b* of the active surface of the cam that is remote from the zone 23*a* is close to the transverse web 5 of the bar 4.

To adjust the height of the roller wheel 2, the user merely has to insert a screwdriver through the opening 22 between the two flaps 20 so as to engage the head 19 of the screw 3, and then rotate the screw 3 so as to displace the plate 15 in the direction of arrow D along the threaded shank 18. This displacement of the plate 15 gives rise to a corresponding displacement of the two links 13 and 13' and thus of the pin 17 mounted through the cam 11. This causes the cam 11 to rotate in the direction indicated by arrow F. During such rotation, the active surface 23 of the cam 11 bears against the top surface 7*a* of the oscillating arm 7.

In the second adjustment position as shown in FIG. 2, the portion of the cam 11 that is bearing on the top face 7*a* of the oscillating arm 7 is now the zone 23*b*, because of the corresponding rotation of the cam 11. Given that the cam 11 is in the form of one-fourth part of an ellipse, the distance L between the axis 14 and said zone 23*b* is greater than the distance l between the axis 14 and the zone 23*a*, so it will be understood that such rotation causes the oscillating arm 7 to be urged downwards, as shown in FIG. 2.

Naturally, it is possible for the user to adopt any appropriate adjustment between these two extreme positions.

Given that the oscillating arm 7 is fixed to the bar 4 via the axis 10 only, the wheel 2 is continuously engaged in its rail. In the event of mis-operation, should the panel be raised, then the wheel will automatically pivot about the axis 10 because of the weight of the roller wheel 2. This serves to avoid any risk of the panel becoming derailed for any reason whatsoever.

However, the fact that the oscillating arm hangs beneath the panel via its axis 10 can be a drawback during installation or removal of the panel.

To remedy this problem, the Applicant has provided for the housing 1 to be fitted with a system for locking the oscillating arm 7, which system can be implemented whenever a panel is to be installed or removed.

Figure 4:
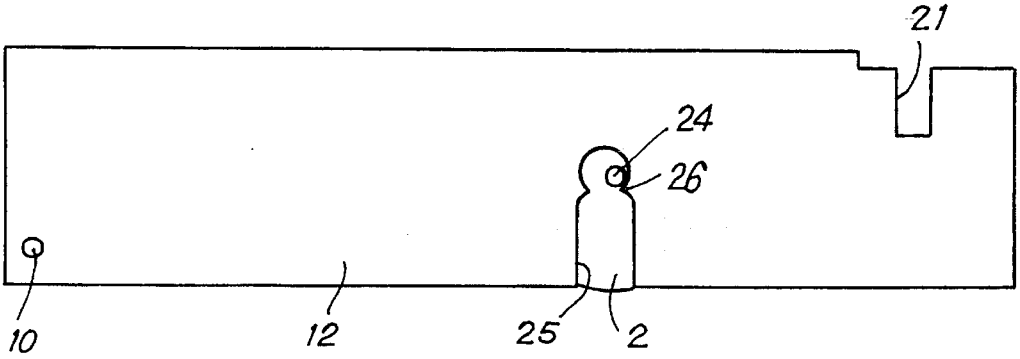
FIG. 4 is a side view of the housing.

In the example shown in FIG. 4, the locking system is constituted firstly by a peg 24 extending the axis of rotation 8 of the wheel 2 in such a manner as to penetrate into a notch 25 formed in the upright flange 12 of the bar 4 and facing said peg 24. Said notch 25 has a special shape. It must allow normal displacement of the peg while the height of the roller wheel is being adjusted. However, it must also allow the position of the oscillating arm 7 to be locked whenever it is in the retracted position as shown in FIG. 1. To do this, the notch 25 includes an inwardly directed point 26 against which the peg 24 engages. The peg 24 is preferably a cylindrical endpiece whose face that is liable to be come into contact with the point 26 is crenellated. This facilitates engaging the peg 24 on the point 26. Thus, when the user seeks to remove the panel, it suffices to turn the adjustment screw 3 so as to raise the wheel 2 into the retracted position shown in FIG. 1. At the end of its stroke, the peg 24 engages on the point 26 with sufficient force to prevent the wheel 2 falling back out under its own weight when the panel is raised.

Figure 5:
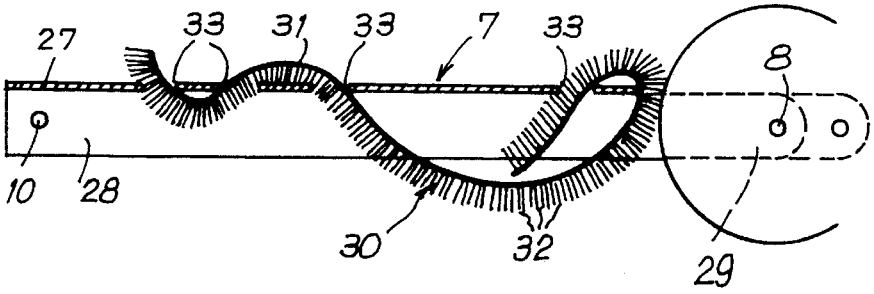
FIG. 5 is a diagrammatic section through the oscillating arm as fitted with a cleaning tab.

FIG. 5 shows an advantageous embodiment in which the housing 1 of the invention is fitted with a pad for continuously cleaning the roller wheel 2 and also the rail on which it slides.

In this case, the oscillating arm 7 is constituted by a channel section bar having a transverse web 27 and two lateral flanges 28. These two flanges 28, at their ends remote from their pivot axis 10 are extended by two vertical flaps 29 which in turn carry the axis of rotation 8 for the wheel 2, and between which said wheel is disposed.

In characteristic manner, the transverse web 27 of the bar constituting the oscillating arm is pierced by a plurality of slots 33 through which a tab 30 is passed. The pad may be constituted, for example, by a semi-rigid tape 31 which is lined on one of its faces with long bristles 32. The function of the slots is to enable the tape 30 to be threaded therethrough and to enable it to be locked in place relative to the oscillating arm 7 so that its bristles 32 bear against the outside surface of the wheel 2 and also project a considerable way below the oscillating arm 7. FIG. 5 shows the path followed by the pad 30 when four slots 33 are used. The pad 30 forms a loop which projects well below the oscillating arm 7. Because the tape 31 is semi-rigid, this loop has the effect of a spring tending to bear against the rail as it runs past close to the roller wheel 2. As shown in FIG. 5, this loop is formed in such a manner as to cause the bristles 32 to come into contact with the wheel 2.

The invention is not limited to the embodiment described above by way of non-exhaustive example. In particular, the free end of the oscillating arm can support sliding means other than a roller wheel. For example, it may support a sliding shoe, or a system that supports a plurality of little wheels.

I claim:

1. A sliding device for a sliding panel, the device comprising:

a) a support which is shaped in or attached to the bottom portion of the panel, said support having a downwardly open upside-down U-shape;

b) an oscillating arm secured to the support about a pivot axis which is horizontal and which extends transversely relative to the U-shape;

c) sliding means fixed towards the free end of the oscillating arm;

d) a pivoting cam which, when rotated, is suitable for causing the oscillating arm to pivot; and e) an adjustment screw whose displacement serves to adjust the angle of rotation of the cam;

wherein the cam is secured to the support via a first axis of rotation and bears against the oscillating arm, and wherein to control rotation of the cam under drive from the adjustment screw, it includes a linkage between the cam and the adjustment screw, said screw being held stationary relative to the support.

2. A device according to claim 1, wherein the linkage comprises two links having respective first ends fixed on either side of the cam by means of a second axis of rotation secured thereto and disposed eccentrically relative to the first axis of rotation which is secured to the support, and having respective second ends secured on either side of a transverse plate which is provided with a tapped orifice, the threaded shank of the adjustment screw passing through said tapped orifice in such a manner that rotation of the screw causes the plate to move rectilinearly along the threaded shank of the screw.

3. A device according to claim 1, wherein the support includes a housing in which the head of the adjustment screw is positioned in fixed manner.

4. A device according to claim 3, wherein the downwardly open U-shaped support further includes two flaps extending the two flanges of the U-shape and including two notches formed in the tops of the flaps to act as the housing for the head of the screw.

5. A device according to claim 1, wherein the cam is substantially in the form of one-fourth of an ellipse, with the first axis of rotation being situated close to a central zone of the ellipse while the second axis of rotation is located towards its periphery, in the vicinity of the small axis of the ellipse.

6. A device according to claim 1, further including means for locking the oscillating arm in position relative to the support when the sliding means is in its high position in the support.

7. A device according to claim 6, wherein the oscillating arm is provided with a peg and the support includes a notch in at least one of the flanges of its U-shape, the shape of the notch allowing the peg to pass therealong while the height of the sliding means is being adjusted, and also allowing the peg to be engaged in a snap-fastening manner when the sliding means reaches its high position.

8. A device according to claim 1, wherein the sliding means consists in a roller wheel, the oscillating bar including fixing means for a cleaning pad that is suitable for bearing against the roller wheel and suitable for extending in the form of a loop beneath the oscillating arm.

9. A device according to claim 8, wherein the pad is constituted by a semi-rigid tape having one of its faces lined with bristles, the oscillating arm advantageously being constituted by a channel section bar whose transverse web is provided with slots through which said tape passes, thereby enabling the tape to be positioned in the form of a loop that extends between the flanges of the channel section beneath the pivoting arm and also bearing against the roller wheel.

* * * * *